US005467616A

United States Patent [19]

Loquet et al.

[11] Patent Number: 5,467,616

[45] Date of Patent: Nov. 21, 1995

[54] PROCESS FOR FORMING A YARN SECURING KNOT IN A FLAT KNITTING MACHINE

[75] Inventors: Rüdiger Loquet, Waasmunster, Belgium; Ulrich Kimmich, Pliezhausen, Germany

[73] Assignee: H. Stroll GmbH & Co., Reutlingen, Germany

[21] Appl. No.: 214,366

[22] Filed: Mar. 16, 1994

[30] Foreign Application Priority Data

Mar. 16, 1993 [DE] Germany ..... 43 08 275.0
Sep. 4, 1993 [DE] Germany ..... 43 29 920.2

[51] Int. Cl.[6] ..... D04B 7/00; D04B 7/24

[52] U.S. Cl. ..... 66/60 R; 66/172 R

[58] Field of Search ..... 66/172 R, 179, 66/60 R

[56] References Cited

U.S. PATENT DOCUMENTS

| | | | |
|---|---|---|---|
| 2,004,699 | 6/1935 | Krautkopf | 66/179 X |
| 2,302,211 | 11/1942 | Green | 66/179 |
| 2,785,554 | 3/1957 | Canavan | 66/179 X |
| 3,057,177 | 10/1962 | Alric | 66/172 R |
| 4,070,873 | 1/1978 | Jansen | 66/172 R |
| 4,413,487 | 11/1983 | Yamaguchi | 66/172 R X |
| 4,548,057 | 10/1985 | Essig | 66/172 R |
| 5,271,249 | 12/1993 | Mitsumoto | 66/60 R |

FOREIGN PATENT DOCUMENTS

| | | |
|---|---|---|
| 0468687 | 1/1992 | European Pat. Off. . |
| 858445 | 8/1952 | Germany . |

*Primary Examiner*—John J. Calvert
*Attorney, Agent, or Firm*—Michael J. Striker

[57] ABSTRACT

The method according to the invention permits the tying off of the free yarn ends, for example in Intarsia knit regions, with a straight knitting machine forming the knit goods without additional auxiliary devices which can negatively influence the structure of the knit goods. The method, in one of its most general forms, includes the steps of looping a new yarn strand in the vicinity of an Intarsia knit region edge of the knit goods with needles of a first and second needle bed to form at least one loop having legs; during successive carriage displacements, crossing both legs of at least one loop formed in the first needle bed to form a crossed-over yarn portion associated with the at least one loops; and looping the at least one loop having the legs crossed over on a needle of the second needle bed via the crossed-over portion.

17 Claims, 15 Drawing Sheets

PROCESS FOR FORMING A YARN SECURING KNOT IN A FLAT KNITTING MACHINE

BACKGROUND OF THE INVENTION

The present invention relates to a method for forming a yarn securing knot with a flat knitting machine having at least two needle beds displaceable toward each other and a carriage with with cam parts for knitting, tucking and transferring devices.

In knit goods, which are made piecewise with different thread or yarn, particularly Intarsia knit goods with different colored and also indirectly assembled Intarsia patterned regions, the free beginnings and endings of the various different yarn strands on one side of the knit goods are free. These free yarn strand ends are knotted subsequently by hand to make a knot to prevent the yarn ends from being drawn into the knit goods and the formation there of holes in the goods. This type of hand knotting of the yarn is time-consuming.

Some attempts have been made to draw the free thread or yarn ends into the goods the knit goods after a kind of tying off process in a straight knitting machine so as to prevent the formation of holes in the knit goods. As a result however nonuniformities in the knit goods, which include hole formation, an arched good shape or nonlinear knit lanes and wales, are formed by the yarn tool at the thread entrance position and thread outlet position.

SUMMARY OF THE INVENTION

The object of the present invention is to provide a method of securing yarn strands which can be performed by a flat knitting machine, which is as good as current methods for tying off yarn pieces by hand and which does not impair the looks of the finished knit goods.

According to the invention, the method for forming a yarn securing knot with a flat knitting machine having a first and second needle bed, each of the needle beds being provided with needles movable toward each other, and a carriage with cam parts for knitting, tucking and transferring devices, comprises the steps of looping an end portion of a new yarn strand to be secured in a knit good at a Knit good region edge of a knit good region, particularly an Intarsia knit region, with the needles of the first and second needle bed to form at least one loop or stitch having legs in the first needle bed; during successive carriage displacements, crossing over both legs of the at least one loop or stitch formed in the first needle bed to form a crossed-over yarn portion associated with the at least one loop or stitch so crossed-over; and transferring the at least one loop or stitch having the legs so crossed over by the crossed-over yarn portion to one of the needles of the second needle bed.

In a preferred embodiment of the invention the method also includes the step of transferring a second loop or stitch with another crossed-over portion to the needle of the second needle bed having the at least one loop or stitch transferred thereon.

In another preferred embodiment of the invention the method further comprises, after transferring the at least one loop or stitch into the second needle bed, placing an additional loop or stitch formed on an adjacent needle in the first needle bed to form a double loop structure and subsequently transferring the double loop structure via a crossed-over portion of the double loop structure to an adjacent needle of the second needle bed.

The method according to the invention can be performed reasonably at least with a modern flat knitting machine, which allows a short carriage stroke and a carriage reversal at each position of the needle bed. The running time of the process according to the invention can be still further reduced when a flat knitting machine is used having several cam systems and which allows several process steps to be performed during a carriage stroke. The method may also be performed with flat knitting machines which have only one combined knitting, tucking and looping system. The knot formation can be improved in a single method step by the use of flat knitting machines with holding-down plates.

The advantages of the method of the invention not only include the elimination of tying off the ends of the yarn by hand, but also that the shape of the knit goods is not changed by the knotting process and that uniform knots are formed. The knots formed at the yarn piece inlet and outlet positions of a Intarsia knit region are close to the rear side of the knot goods. No visible yarn masses or holes in the knit goods arise. A uniformly straight course of the loop rows and the wales is present at the overlapping positions and corners of the Intarsia knit goods region. Sharp colored edges are maintained at the tying off position and no yarn excess occurs in a neighboring knit region, by which the color border at tied off positions can be blurred.

BRIEF DESCRIPTION OF THE DRAWING

The objects, features and advantages of the present invention will now be illustrated in more detail by the following detailed description, reference being made to the accompanying drawing in which.

DESCRIPTION OF THE PREFERRED EMBODIMENTS

Figure 1:
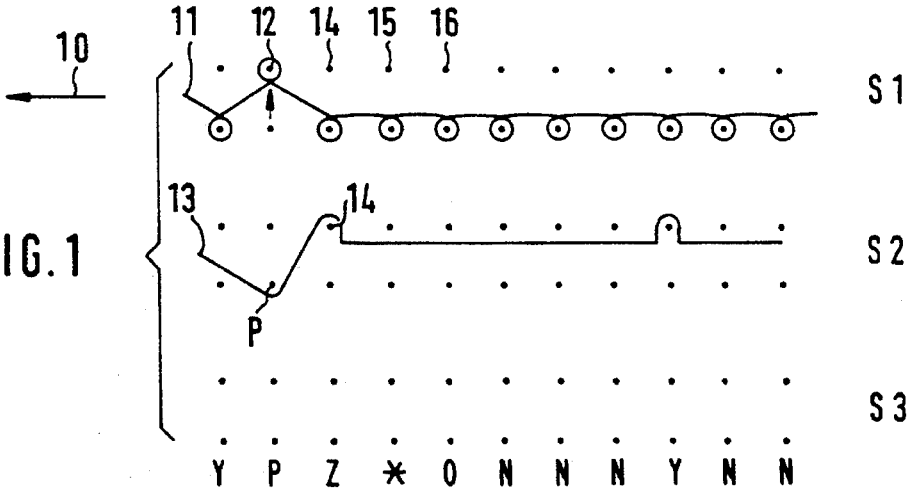
FIGS. 1 to 9 are yarn running illustrations of a first embodiment of the method of forming a yarn securing knot at the yarn inlet position of an inlay knitting area.
Figure 2:
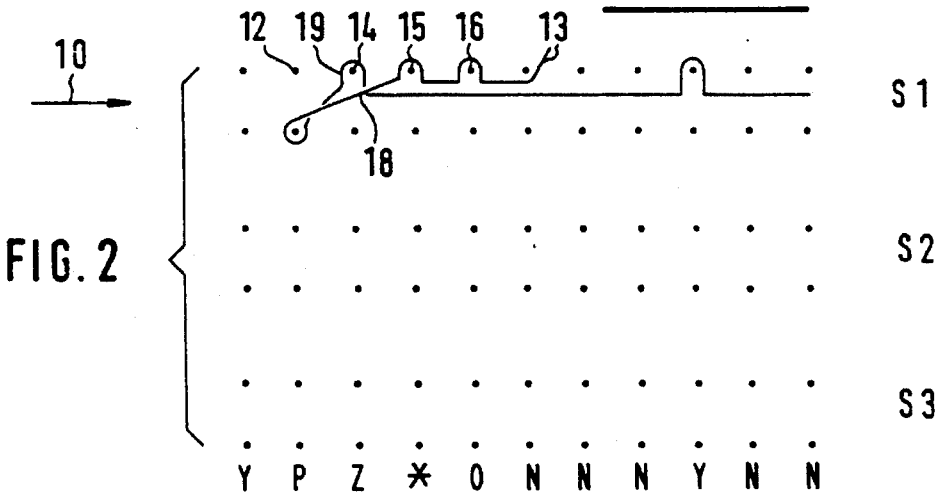
Figure 3:
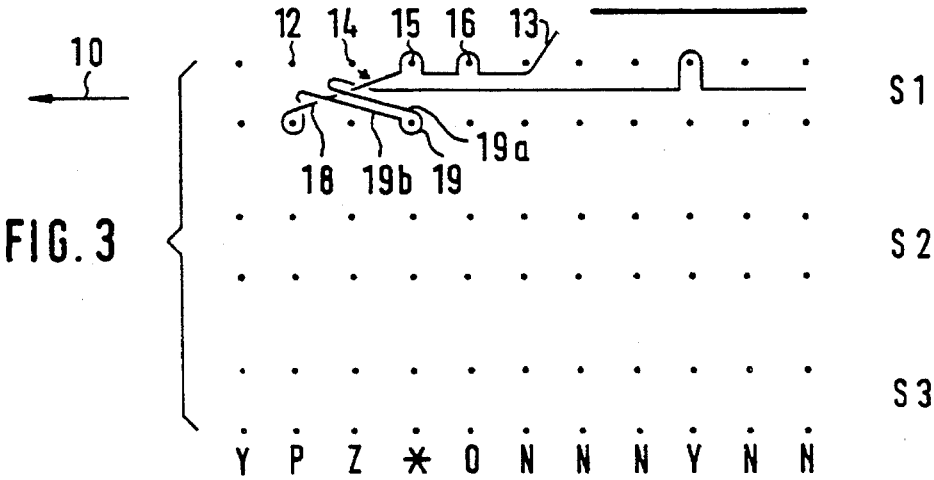

Twin rows of points, which symbolize in a known way the needles of two needle beds cooperating with each other, for each of three cam systems of a flat knitting system are shown in each of FIGS. 1 to 18 and 21 to 36. The lower row of points of each twin row symbolizes the needles of the front needle bed, the upper row of points symbolizes the rear needle bed of a flat knitting machine. The upper twin row shown in the individual figures is associated with the preponderantly used cam system S1; the middle twin row, to the second cam system S2 and the lower twin row, to the third cam system S3. The combined operating systems are used to perform the "knitting", "tucking" and "transferring" operations. In the individual figures the upper twin row of points associated with the operating system S1 can be thought of as the leading cam system on the carriage carrier device and the lower twin row, as the trailing cam system. The cam system S1 is also always leading the cam systems S2 and S3. The carriage running direction is shown with an arrow 10 on each side of each of the FIGS. 1 to 18 and 21 to 36. The individual needles of the lower point rows of the cam systems, of the front needle bed, are indicated in the drawing with letters and symbols for easy orientation. The needle indicated with the star symbol marks the start or end of an Intareia knit field.

FIGS. 1 to 9 show the steps of a first method of forming a yarn securing knot at the entrance position of an Intarsia yarn piece.

FIG. 1 shows above the last knit plain stitch row, later designated the old yarn strand, made from a yarn strand 11 with all the needles of the front needle bed. It can be the last stitch row of an Intarsia-knit region or however also the last stitch row of a base knit region. A stitch is transferred from the front needle bed to the neighboring needle 12 of the rear needle bed by the first cam system S1 during the motion of the carriage according to arrow 10 from right to left. It is at the position P the above-next needle to the needle which position is indicated with the star symbol at the front needle bed, at which a new Intarsia knit region begins. During the same carriage motion with the cam system S2 an Intarsia yarn strand 13, designated subsequently as the new yarn strand, is looped around some needles of the rear needle bed, lastly to a loop 19 around the needle 14, which is associated to the position Z of the front needle bed. Subsequently the new yarn strand 13 is knit to a loop by the previously freed needle P of the front needle bed and subsequently the carriage reverses its motion direction. The new yarn strand 13 is knit in loops by the needles 15 and 16 of the rear needle bed by the cam system S1 according to FIG. 2, thereby a crossover of both legs of the loop 19 formed on the needle 14 occurs by a yarn strand bridge 18 of the new yarn strand 13 and thus loop 19 is held down.

After a needle bed displacement and a carriage motion reversal the loop 19 formed on the needle 14 of the lower needle bed and held down by the yarn strand bridge 18 of the new yarn strand 13 is transferred to the needle of the front needle bed indicated with the star symbol by the cam system S1. Both legs 19*a* and 19*b* of the loop 19 extend now over the yarn strand bridge 18 of new yarn strand 13.

Figure 4:
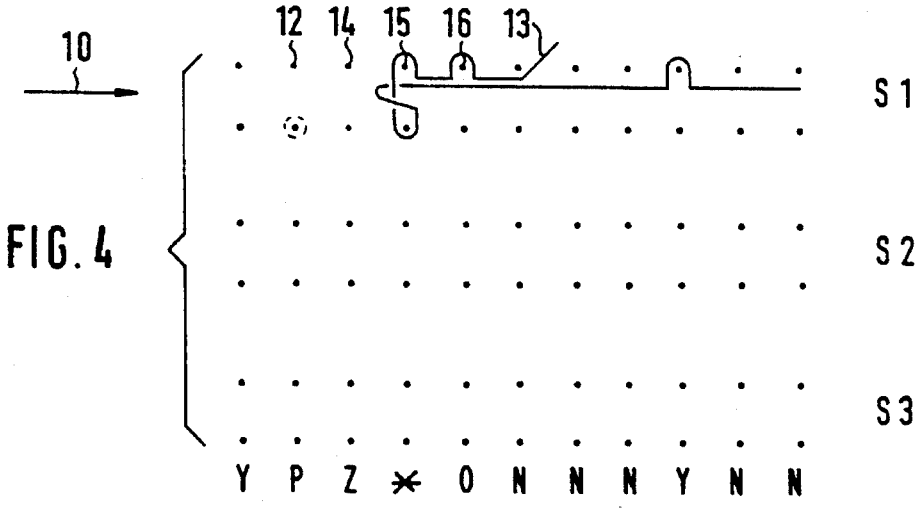

After the next carriage motion reversal according to FIG. 4 the loop formed on the needle P of the front needle bed is cast off by the cam system S1 and because of that sufficient yarn material is obtained for the further knot forming process. After the next carriage motion reversal according to FIG. 5 the new yarn strand 13 is drawn with an additional yarn strand bridge 20 until at needle P of the front needle bed and there knit in a loop.

Figure 6:
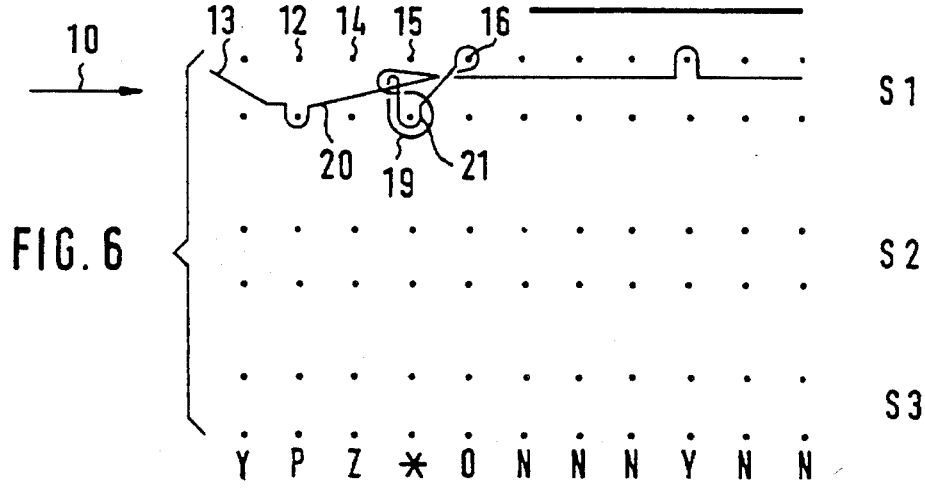
Figure 7:
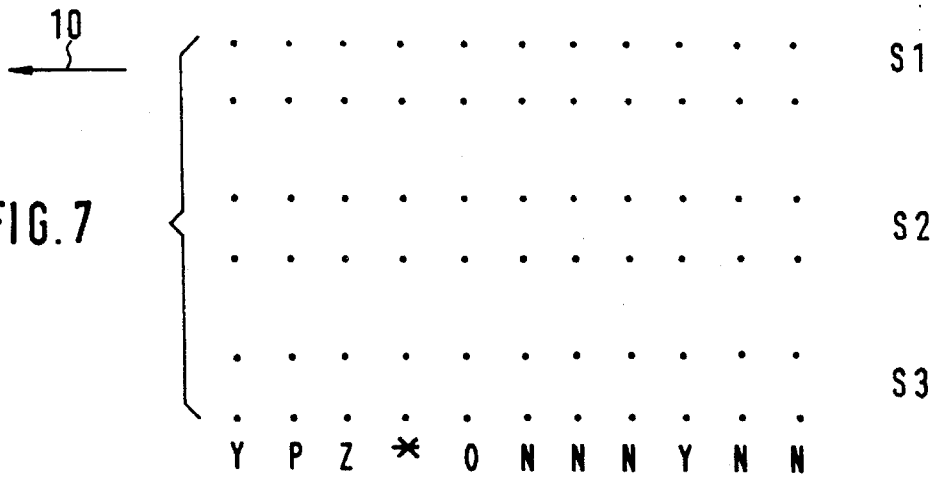
Figure 8:
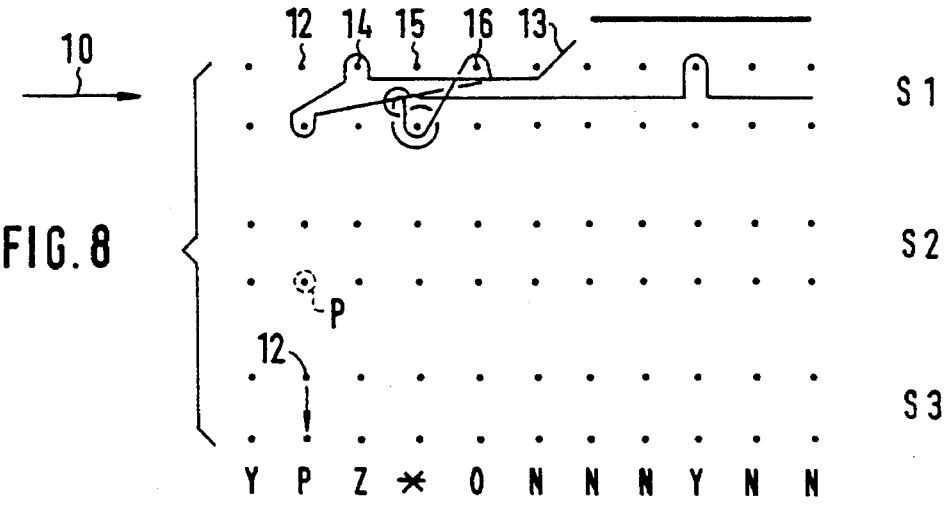

The loop 21 located on the needle 15 of the rear needle bed, whose legs are held down by the yarn strand bridge 20 of the new yarn strand, is transferred to the needle of the front needle bed indicated with a star symbol, where the loop 19 is already found, during the subsequent carriage motion according to FIG. 6. After the next carriage motion reversal according to FIG. 7 no work occurs in the knot forming region, only a further drawing of the loops. Next after the subsequent .carriage reversal as shown in FIG. 8 the new yarn strand 13 is knit in a loop on the needle 14 of the rear needle bed with the cam system S1 and subsequently is pulled over the legs of the loop on the needle 16. The loop on the needle P of the front needle bed is cast off with the next following cam system S2, and the old stitch found still on the needle 12 of the rear needle bed is moved back to the needle P of the front needle bed by the next following cam system S3.

Figure 9:
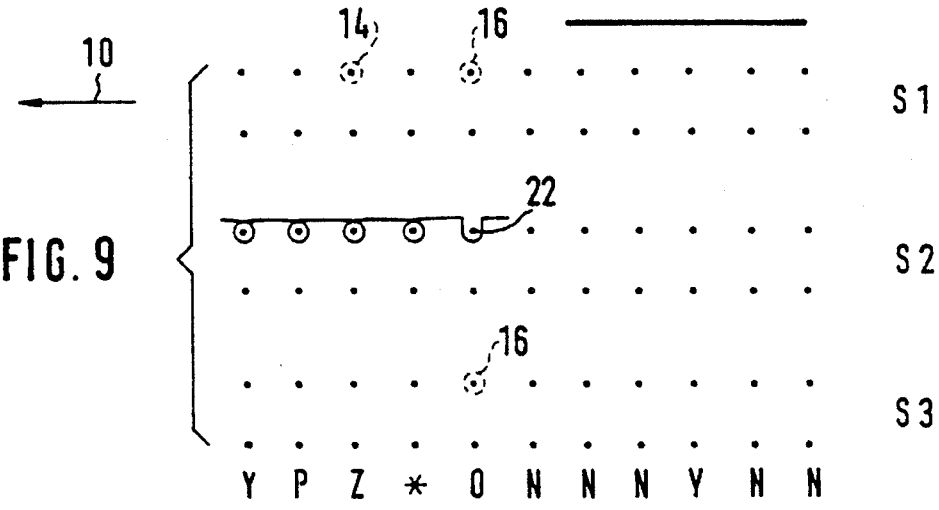
Figure 10:
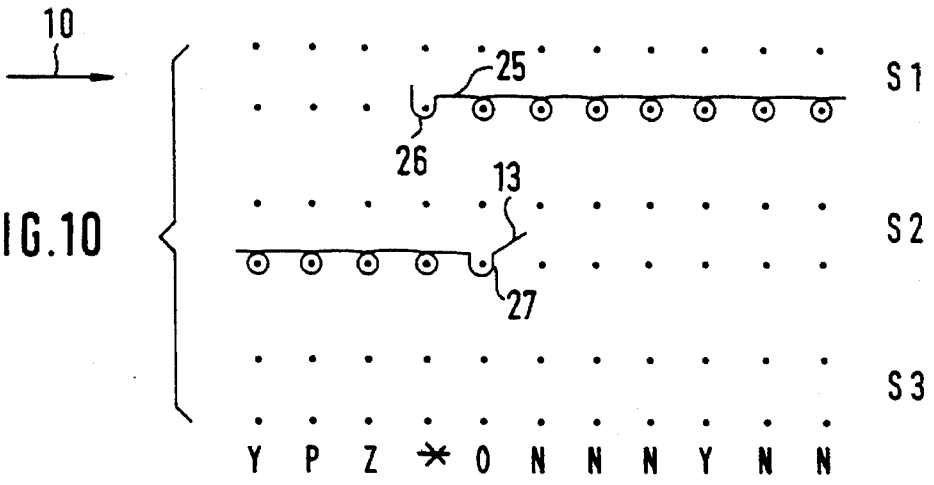
FIGS. 10 to 18 are yarn running illustrations of the first method of forming the yarn securing knot at the yarn outlet position of an inlay knitting area.
Figure 11:
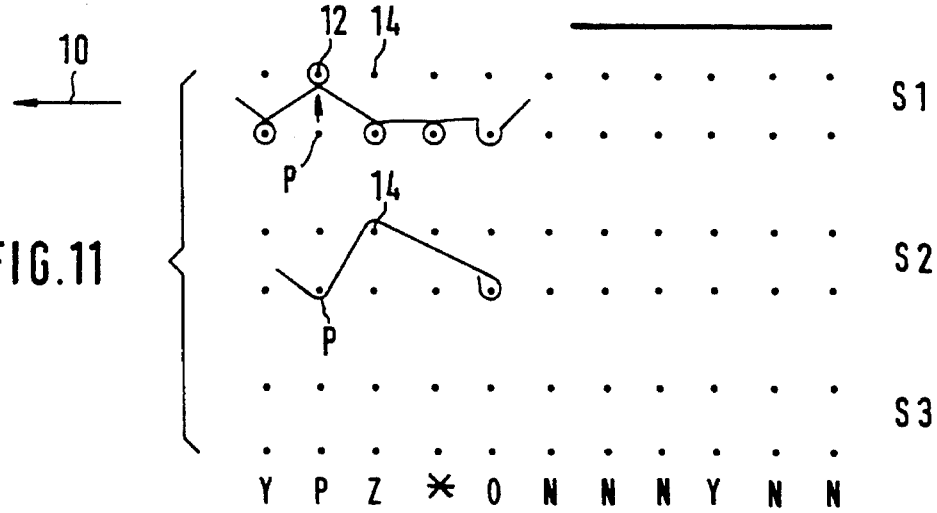
Figure 12:
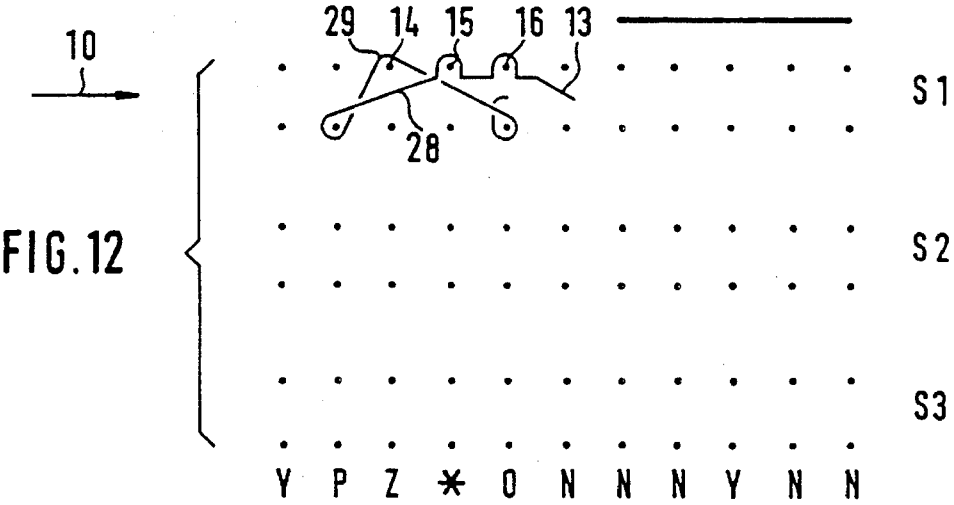
Figure 13:
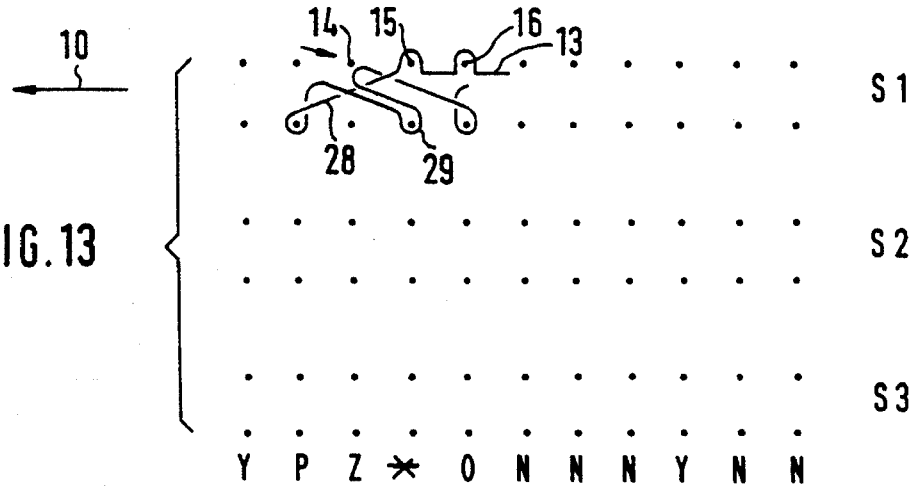
Figure 14:
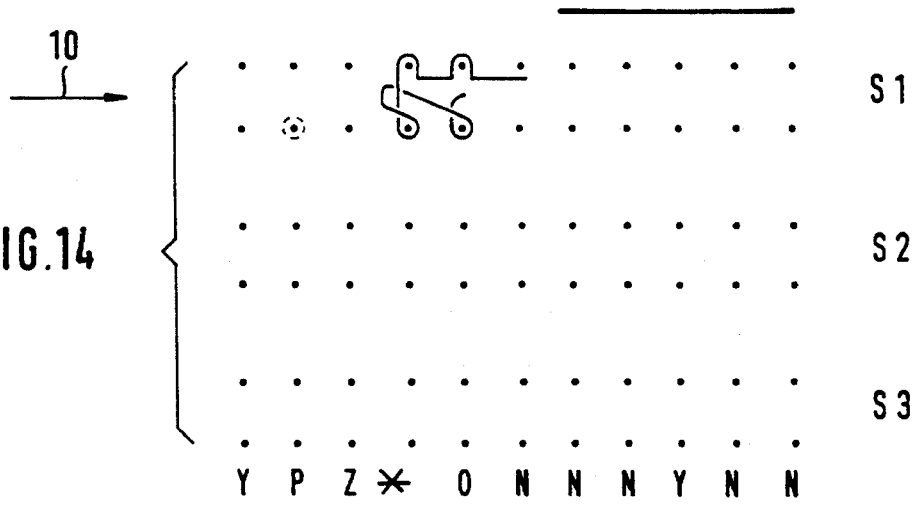
Figure 15:
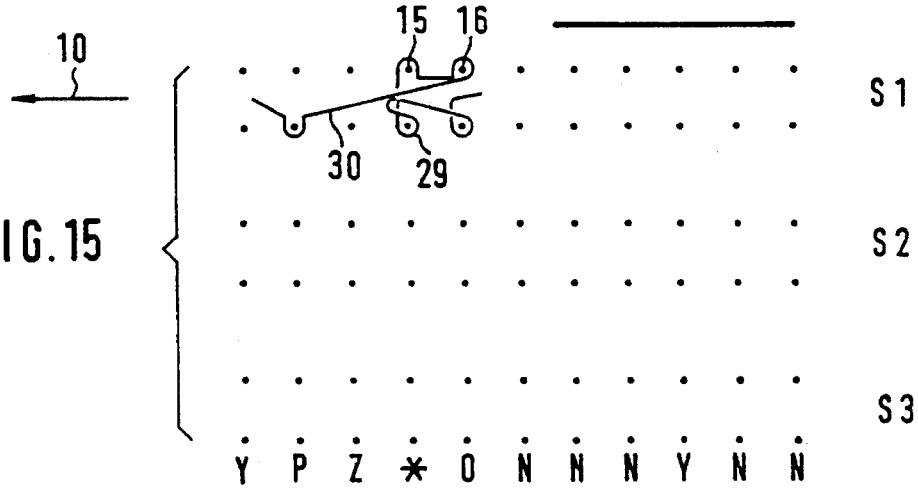
Figure 16:
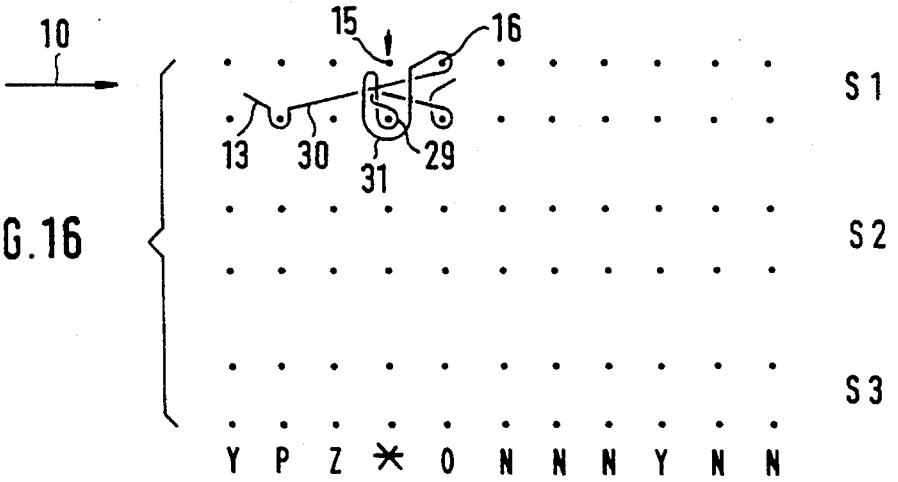

The loops of the needles 14 and 16 of the rear needle bed are cast off the cam system S1 after the next carriage motion according to FIG. 9, A plain stitch row is formed with the new yarn strand with the needles of the front needle bed on the cam system S2, beginning with a loop 22 on the needle at the position indicated by a symbol O at the front needle bed. The needle 16 is moved once more into a casting off position reliably with the aid of the cam system S3. The knot is finished and no new yarn strand is found any longer outside of the subsequently formed Intarsia knit region.

Figure 5:
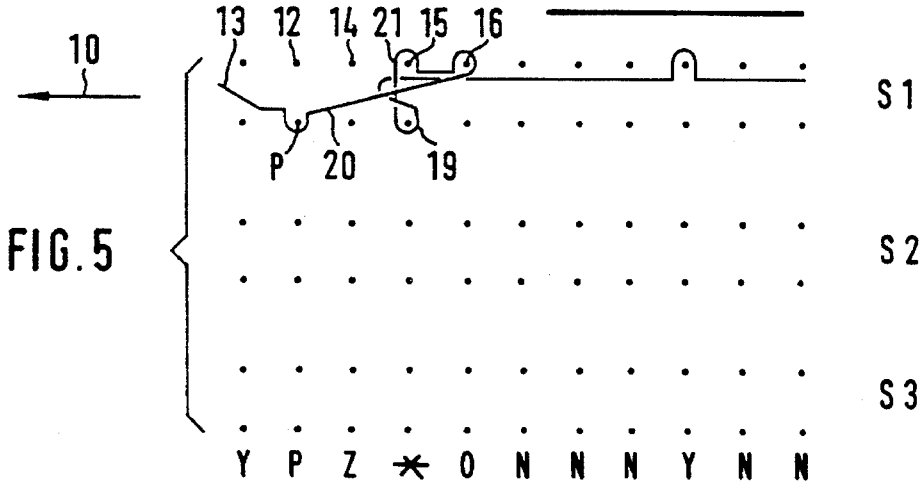

FIGS. 10 to 18 show the course of a first method for making a tying-off knot with the Intarsia yarn strand after making an Intarsia knit region, again from carriage stroke to carriage stroke. First a plain stitch row is made with a new yarn strand 25 and the cam system S1 on the needles of the front needle bed during a carriage motion from left to right, beginning with a loop 26 on the needle of the front needle bed indicated with a star symbol, at whose level the previously knit Intarsia knit region ends. A plain stitch row of the Intarsia knit region is knit once again with the needles of the front needle bed and with the Intarsia yarn strand 13 until at the needle indicated with a star symbol with the following cam system S2. A loop 27 iS formed with the Intarsia yarn strand 13 on the adjacent needle of the front needle bed indicated with the symbol O. Subsequently a carriage reversal occurs and according to FIG. 11 the stitch on the needle P of the front needle bed is transferred to the needle 12 of the rear needle bed by the cam system S1. The yarn strand 13 is drawn to the needle 14 of the rear needle bed from the needle indicated with the symbol O by the cam system S2, there knit in a loop and subsequently knit in a loop on the freed needle P of the front needle bed. After a fresh carriage reversal then according to FIG. 12 with the cam system S1 loops are knit on the needles 15 and 16 of the rear needle bed analogous to the yarn guiding operation of FIG. 2, in which the yarn strand 13 holds down the legs of the loop 29 formed on the needle 14 with a yarn strand bridge 28. After next carriage reversal and after a needle bed displacement according to FIG. 13 and analogous to FIG. 3, the loop 29 is transferred to the needle indicated with the star symbol of the front needle bed, whereby the legs of the loop 29 crossover the yarn strand bridge 28 of the Intarsia yarn strand 13. During the next two carriage displacements apparent in FIGS. 14 and 15 a process analogous to that in FIGS. 4 and 5 is occurring, thus the loop found on the needle P is cast off and subsequently a fresh loop is knit with the yarn strand coming from the needle 16 with this needle P, whereby an additional yarn strand bridge 30 is formed. The remaining knot formation according FIG. 16 occurs analogous to FIG. 6 by transferring the loop 31 on the needle 15 to the needle indicated with the star symbol already carrying the loop 29.

Figure 17:
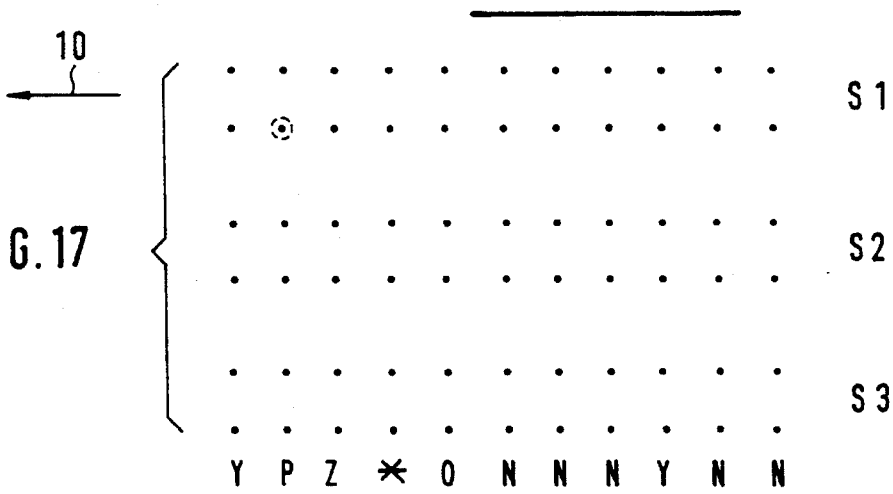
Figure 18:
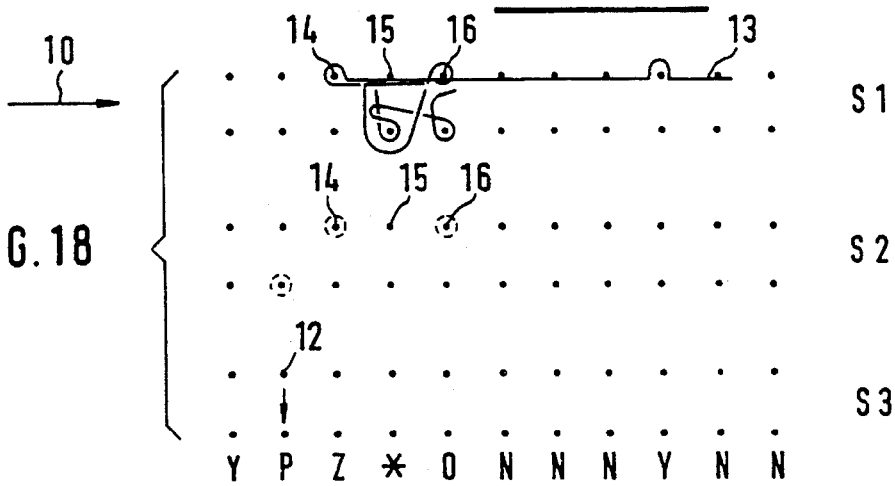

After the next carriage reversal as shown in FIG. 17 the loop on needle P of the front needle bed is cast off, and, after the next carriage reversal according to FIG. 18 with the cam system S1 a loop is formed on the needle 14 with the end of the Intarsia yarn strand 13 to be tied off. This yarn strand is subsequently pulled over the legs of the loop still found on the needle 16 and a new 1cop is knit on an adjacent needle spaced from it. The needle P of the front needle bed is once again brought into a casting off position with the reliable aid of the cam system S2, and also the needles 14 and 16 of the rear needle bed are brought into a yarn casting off position. The stitch initially transferred to the needle 12 of the rear needle bed is retransferred on the needle P of the front needle bed by means of the cam system S3.

Figure 19:
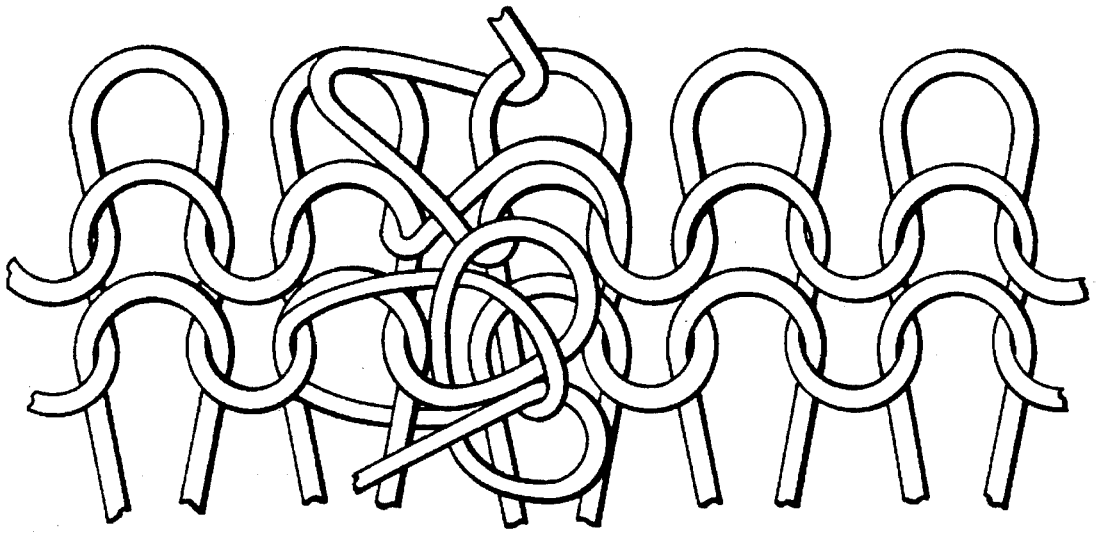
FIG. 19 is a rear view of knit goods provided with a yarn securing knot according to the first embodiment of the invention.
Figure 20:
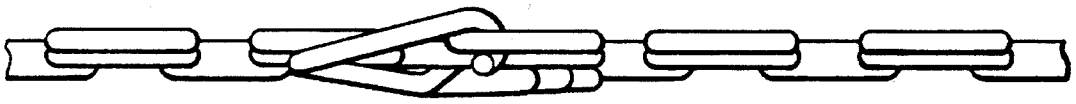
FIG. 20 is a cross-sectional view through the knit goods shown in FIG. 19 at the position of the yarn securing knot.

It is understood that yarn strands can be tied off with the method according to the invention not only in Intarsia knit goods, but also in other knit goods at various desired positions. As shown in FIG. 19 and 20 no hole formation and no distortion the wales and knit lines can be detected at the knotted positions. Furthermore the knots formed are close to the knit goods.

FIGS. 21 to 28 show the steps of a second process for forming a yarn securing knot in an Intarsia yarn strand entrance location of the strand in knit goods from carriage stroke to carriage stroke. The needles of the lower and upper row of points of the cam systems, also the first(front) or second (lower) needle bed, are indicated with the reference numbers 112 to 118 or 122 to 128. The needles indicated with a star symbol mark the beginning or the end of the Intarsia knit field.

Figure 21:
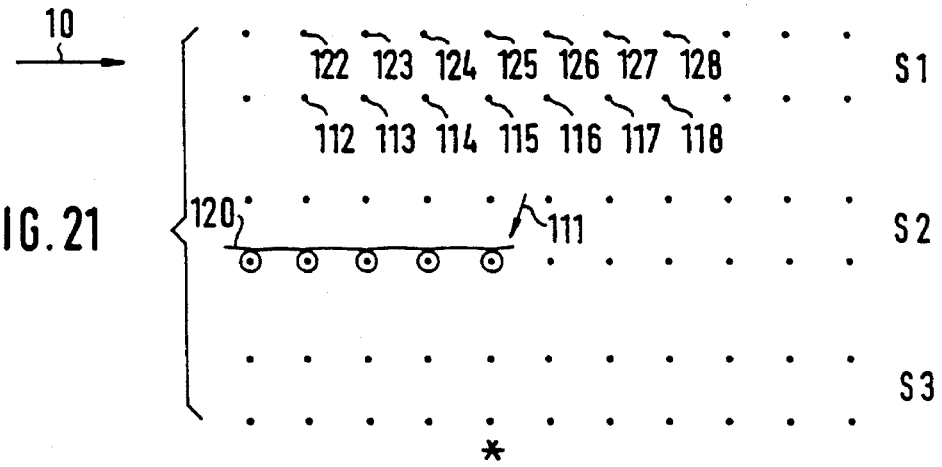
FIGS. 21 to 28 are yarn running illustrations of a second embodiment of the method of forming a yarn securing knot at the yarn outlet position of an inlay knitting area.
Figure 22:
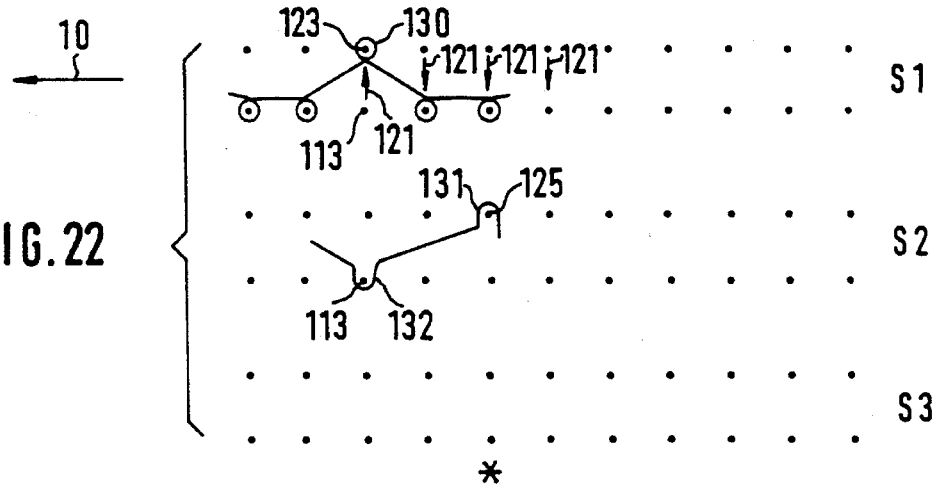
Figure 23:
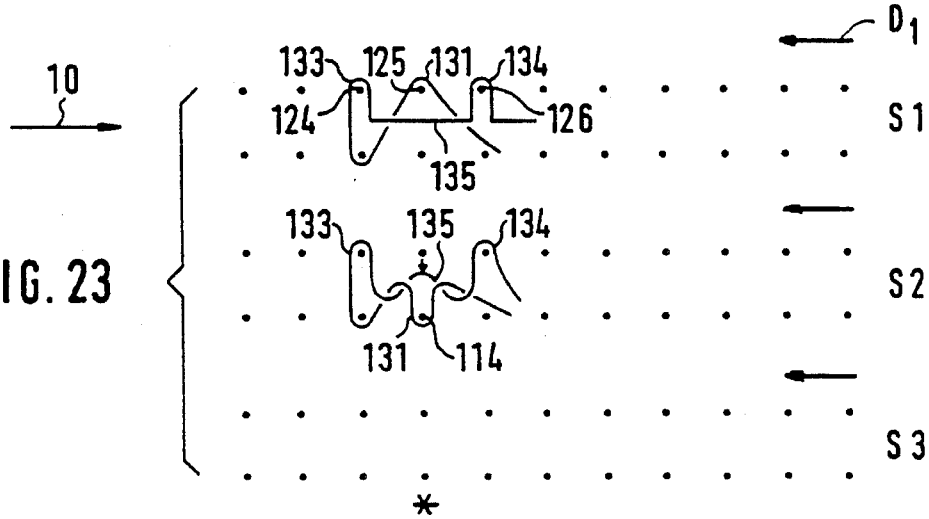

First a plain stitch row is knit on the first needle bed until at the desired knit goods region end with the subsequently to be tied off or knitted yarn strand 120 during a carriage stroke from left to right with one of the cam systems, here the cam system S2(See FIG. 21). The yarn guide 111 shown swung out in the drawing stands at the end of the Intarsia knit field made with the yarn 120. After a carriage displacement according to FIG. 22 stitches located in front of the knit goods region end are moved from the second needle bed to the first needle bed, which is indicated with the arrows 121. Furthermore a stitch 130 formed previously in front of the desired knit goods region inside the knit region is moved to the needle 123 of the second needle bed. This step is performed by the leading cam system S1, while by the cam system S2 a loop 131 is formed on the needle 125 of the second needle bed adjacent to the knit goods field end and subsequently a loop 132 is formed on the needle 113 of the first needle bed released previously by the hanging over of the stitch 130, both with the yarn 120. Subsequently after a reversal of the carriage displacement direction 10 and a displacement D of the second needle bed by a needle division relative to the reversed carriage motion direction according to FIG. 23 the yarn strand 120 to be knotted is worked in the second needle bed into respective loops 133,134 on the needles 124, 126 adjacent to the loop formed on the needle 125 in the subsequent process step, whereby the legs of the loop 131 on the needle 125 are crossed over by a yarn strand bridge 135. The loop 131 located on the needle 125 of the second needle bed, whose legs are crossed by the yarn strand bridge 135, is moved to the needle 114 of the first needle bed with the trailing cam system S2 and thus crossing the yarn strand bridge 135 with the leading cam system S2.

Figure 24:
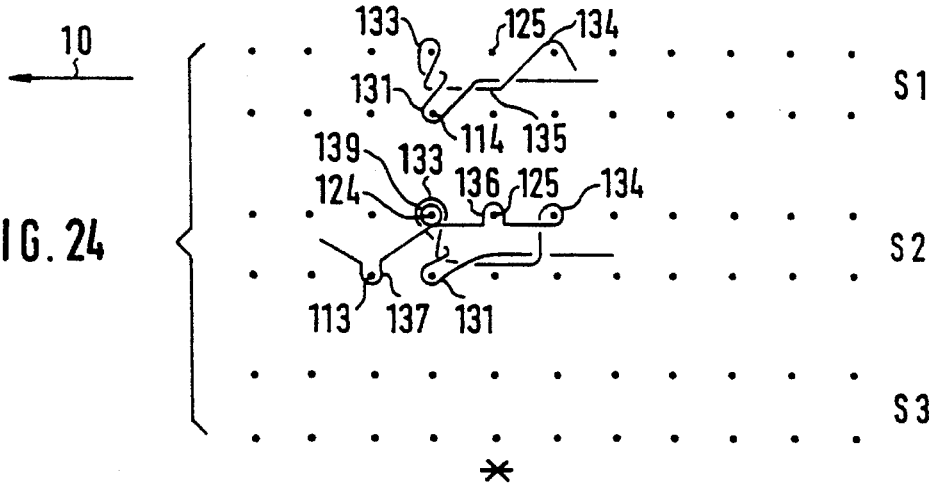

After a new carriage motion reversal and a return displacement of the second needle bed the loop looped around the needle 113 of the first needle bed is cast off by the leading cam system (FIG. 24). By the trailing cam system S2 a loop 136 is formed with the needle 125 in the second needle bed and a stitch 139 is formed with needle 124, which already carries a previously formed loop 133, on which then a loop 137 made in a first needle bed with the needle 113 follows.

Figure 25:
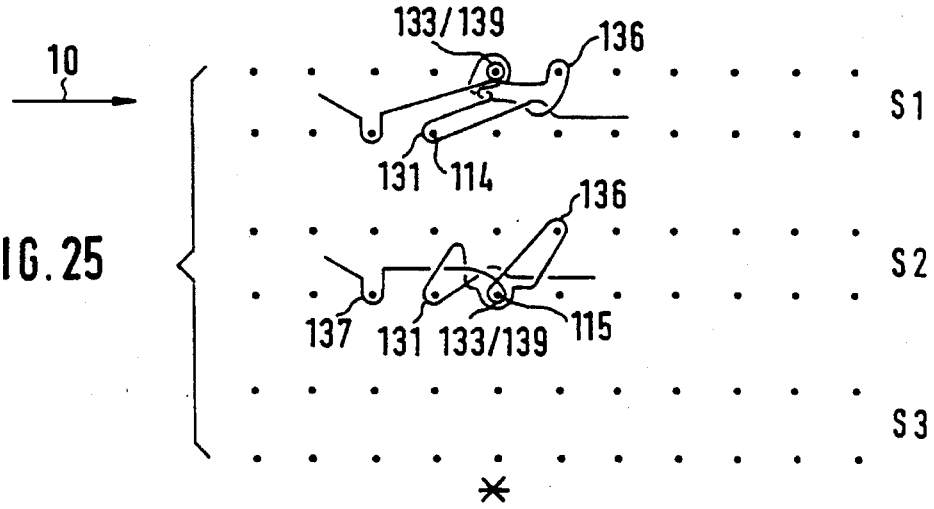
Figure 26:
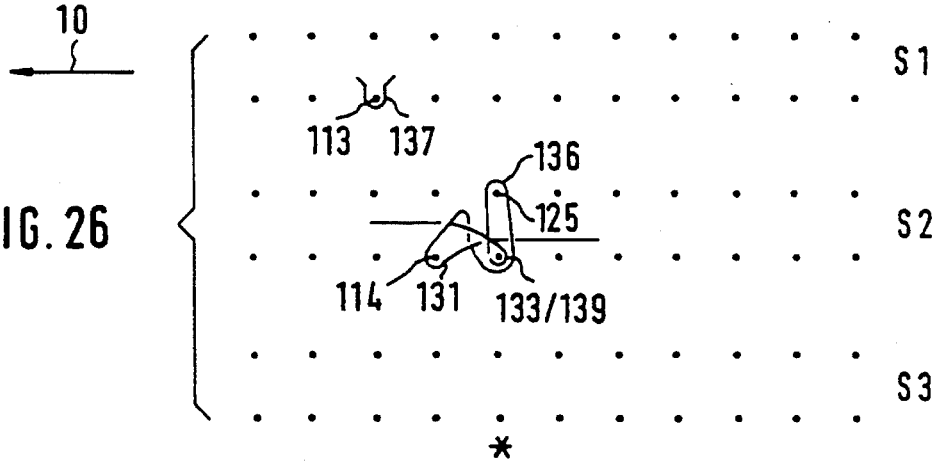
Figure 27:
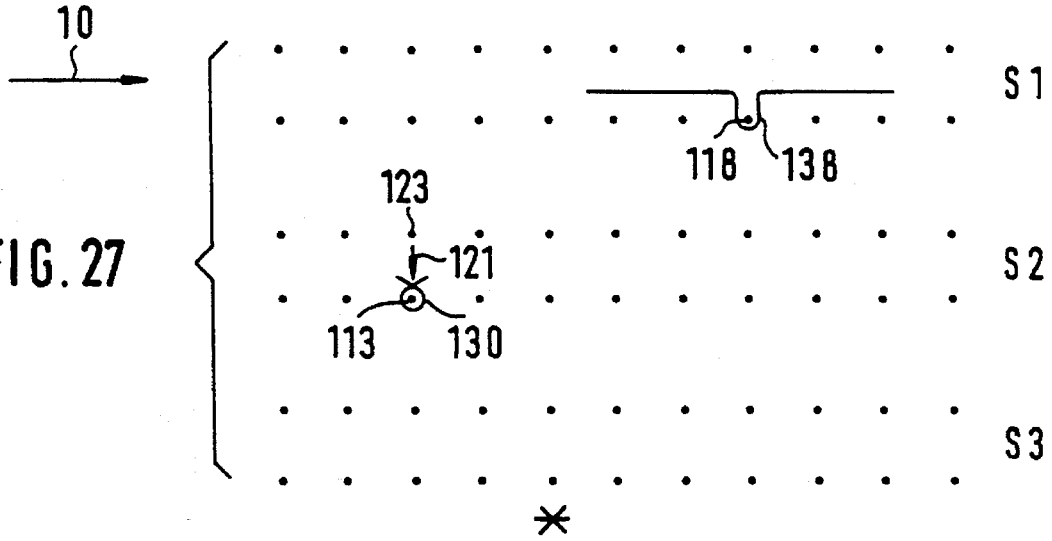
Figure 28:
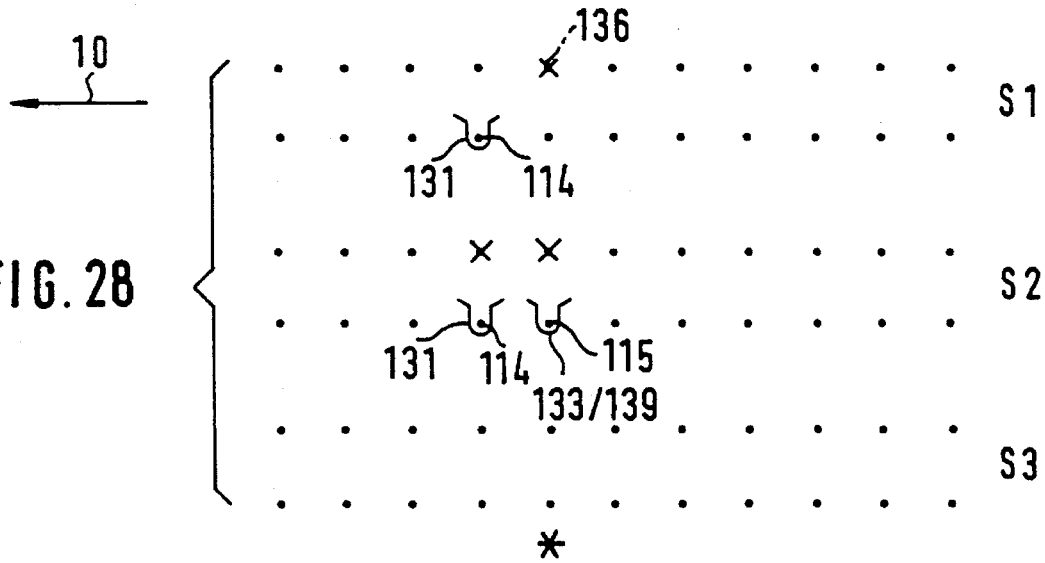

The loop 134 formed earlier on the needle 126 of the second needle bed is cast off by the leading cam system S1 after a new carriage motion reversal and a displacement of the second needle bed according to FIG. 25. By the trailing cam system S2 the stitch 139 which is carried together with the loop 133 on the needle 124 is moved over the legs of the loop 131 found on the needle 114 of the first needle bed to the adjacent needle 115 of the first needle bed. Subsequently at a new carriage reversal according to FIG. 26 the second needle bed is reset and in the new carriage displacement direction 10 a sinking of the loop 137 located on the needle 113 of the first needle bed is caused by the leading cam system S1, before it is cast off by the trailing cam system S2. According to FIG. 27 a loop 138 is formed on a needle 118 of the first needle bed found outside of the prepared Intarsia knit region by the leading cam system S1. By the trailing cam system S2 the stitch 130 moved initially to the needle 123 of the second needle bed is again moved to the needle 113 of the front needle bed. Subsequently after the next carriage reversal and a new displacement of the second needle bed the loop 136 remaining on the needle 125 of the second needle bed is cast off by the leading cam system S1 and the loop 131 found on the needle 114 of the first needle bed is sunk, while the loops 131, 133 and stitch 139 on the needles 114 and 115 in the first needle bed are sunk by means of the trailing cam system S2, as shown in FIG. 28.

Figure 29:
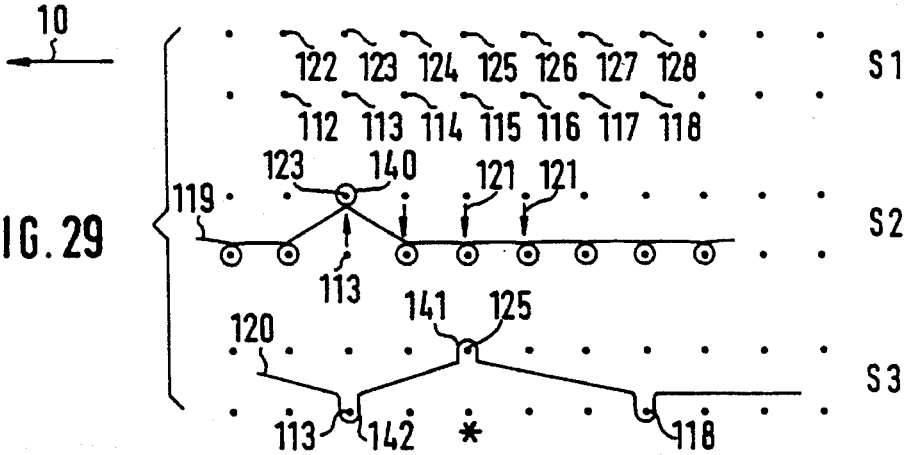
FIGS. 29 to 36 are yarn running illustrations of the second embodiment of the method of forming a yarn securing knot at the yarn inlet position of an inlay knitting area.
Figure 30:
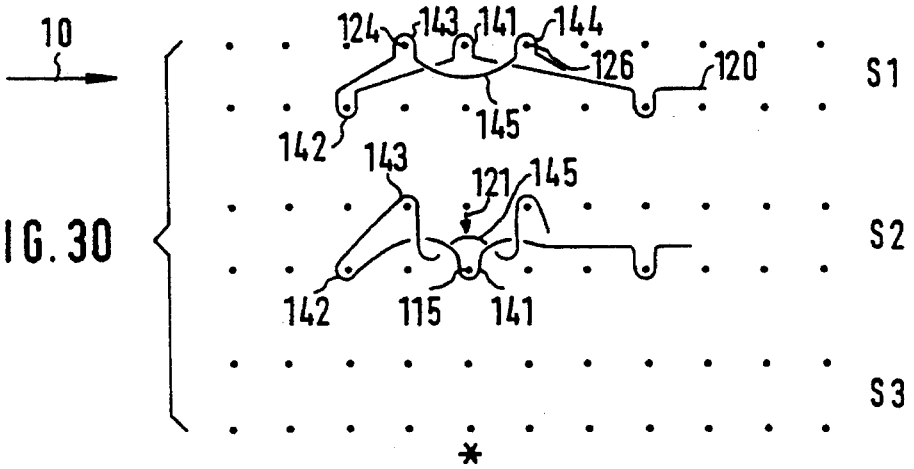

Some stitches from the second needle bed are looped in the first needle bed in a plain stitch row formed from the old yarn strand 119 with the needles of the first needle bed closing the old yarn strand in the first needle bed in the vicinity of the beginning position * of the new yarn strand region indicated by a star symbol in FIG. 29, which is indicated by arrows 121 in FIG. 29, in a second kind of formation of the knot provided at the beginning of a new Intarsia knit goods region. Furthermore a stitch 140 of the plain stitch row is transferred from a needle 113 of the front needle bed outside of the Intarsia field boundary with the leading cam system to the corresponding needle 123 of the rear needle bed, as is indicated by an arrow. Loops from the new yarn strand 120 to be secured are formed with the needle 118 and with the needle 113, just released by the transferring, of the first needle bed and with the needle 125 located on the Intarsia region boundary * of the second needle bed. In the illustrated example the loop 141 formed with the needle 125 of the second needle bed is removed two needle spaces from the loop 142 formed in the first needle bed on the needle 113 freed from the old yarn strand stitch 140. After a carriage motion reversal—the carriage motion direction is indicated again by the arrows 10—as shown in FIG. 30 loops 143 and 144 are made by the leading cam system S1 with respective needles 124 and 126 with the new yarn strand 120 coming from the previously formed loop 142. The loops 143 and 144 are situated on both sides of the loop 141 formed before with the needle 125 with the leading cam system S1. The new yarn strand 120 between both new loops 143 and 144 thus forms a yarn strand bridge 145 holding down the legs of the loop 141. The loop 141 held at its legs by the yarn strand bridge 145 is transferred to the needle 115 of the first or front needle bed crossing over the yarn strand bridge 145.

Figure 31:
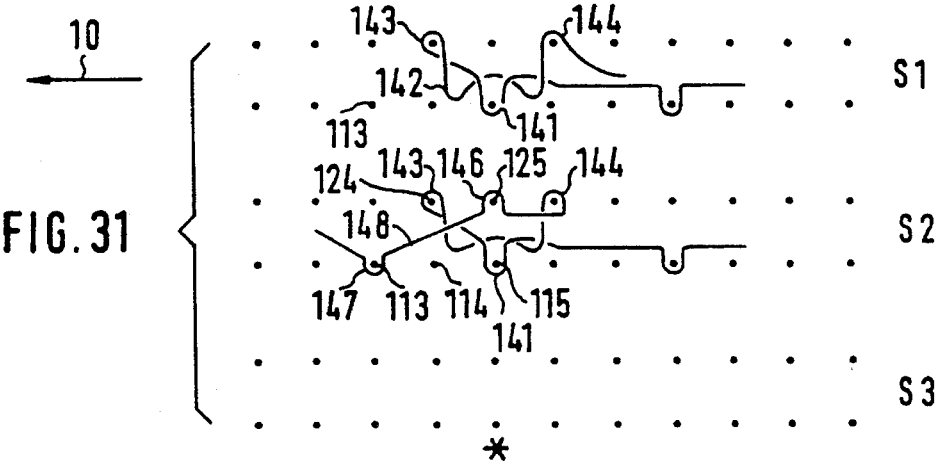

After a new carriage reversal according to FIG. 31 the loop 142 formed earlier on the needle 113 of the first needle bed is cast off with the leading cam system S1. With the following cam system S2 a new loop 146 originating from the earlier formed loop 144 is formed on the needle 125 released earlier from the loop 141 and subsequently a new loop 147 is formed in the first or front needle bed on the needle 113 released earlier by the casting off of the loop 142. Now yarn strand bridge 148, which lies over the legs of the loop 143, extends between both new loops 146 and 147.

Figure 32:
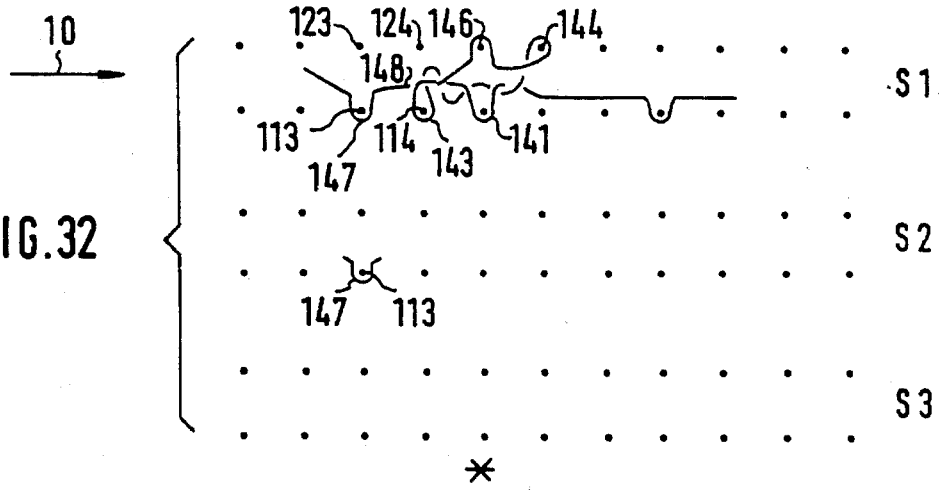
Figure 33:
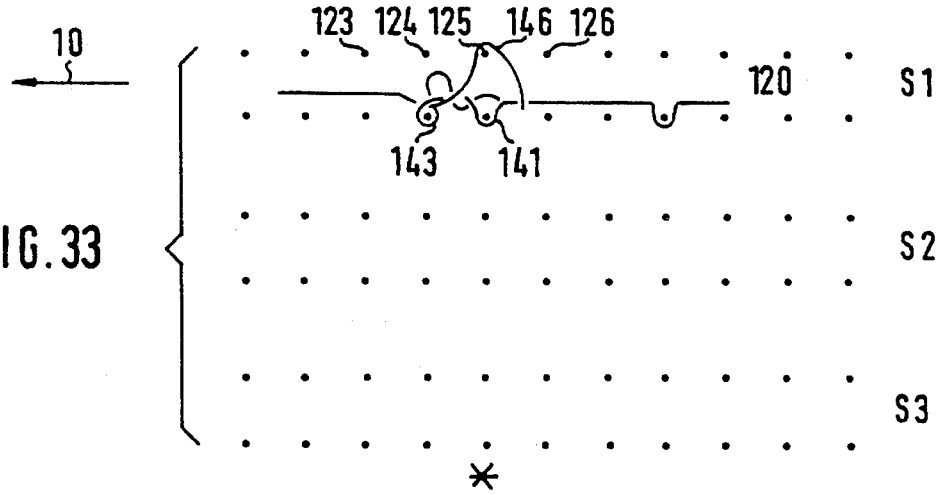
Figure 34:
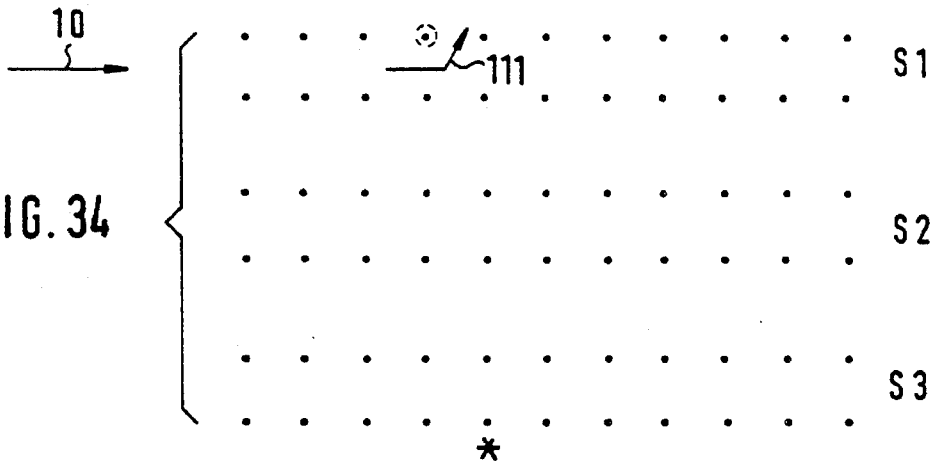
Figure 35:
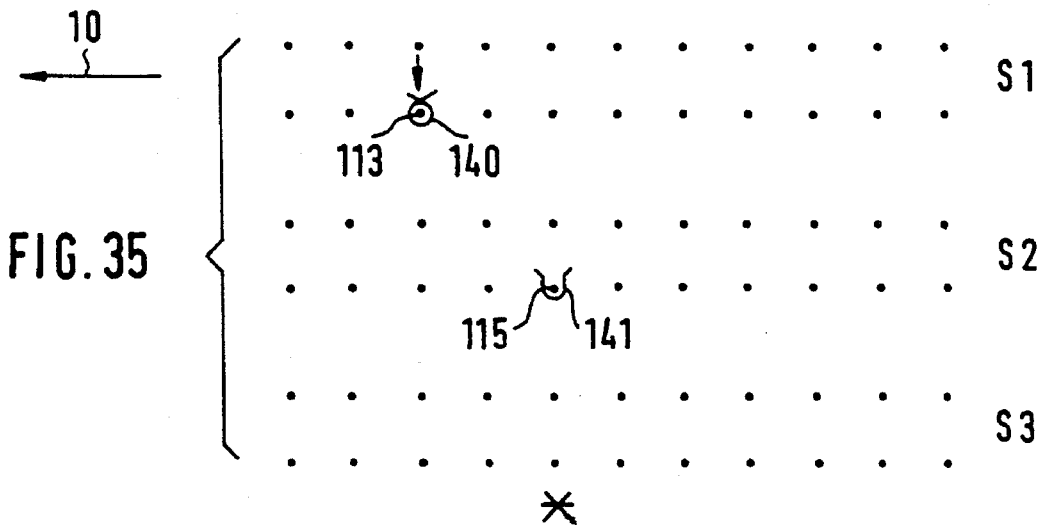
Figure 36:
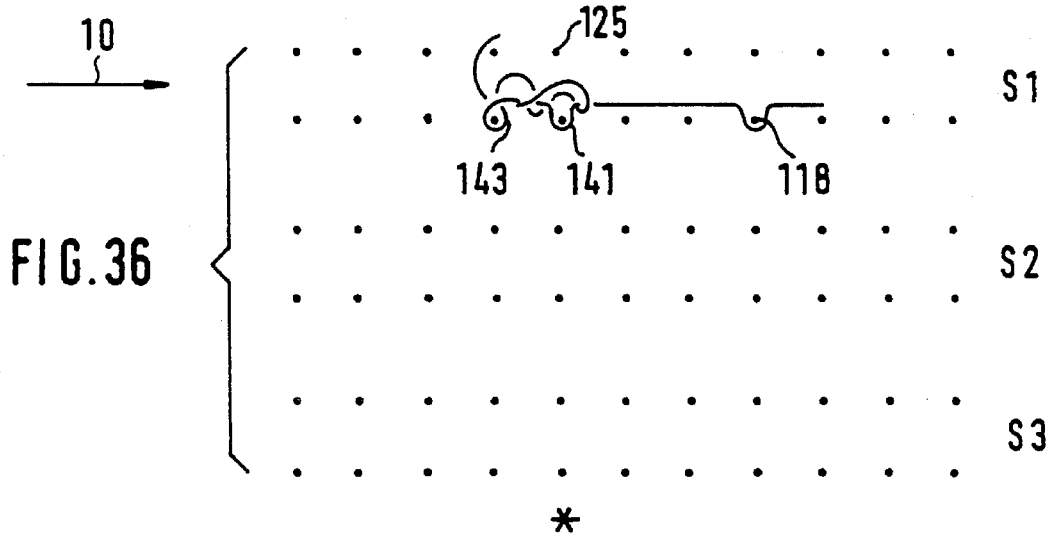

After the next carriage motion reversal according to FIG. 32 the loop 143 held by its legs by the yarn strand bridge 148 on the needle 124 of the second or rear needle bed is transferred to the corresponding needle 114 of the first needle bed and thus brought beside the already earlier formed loop 141 by the leading cam system S1. The loop 143 is thus placed over the previously formed yarn strand bridge 148. An additional drawing of the loop 147 formed on the needle 113 of the first needle bed is caused by the following cam system S2. The loop 144 located on the needle 126 of the second needle bed is cast off with the cam system S1 after the next carriage motion reversal, like the additionally drawn loop 147 on the needle 113 of the front needle bed (FIG. 33), After a new carriage motion reversal according to FIG. 34 the yarn guide 111 guiding the new yarn strand 120 swings out, and, after the next carriage motion reversal, the at-the-beginning transferred old yarn strand stitch 140 is retransferred in the first needle bed by the leading cam system S1 and with the following cam system S2 the loop 141, found on the needle 115 of the first needle bed, is additionally drawn (FIG. 35). After the next carriage motion reversal according to FIG. 36 the loop 146 of the needle 125 of the second needle bed is cast off with the cam system S1 and an additional drawing of the loops 141, 143 of the knot, which is now formed, occurs once more.

Figure 37:
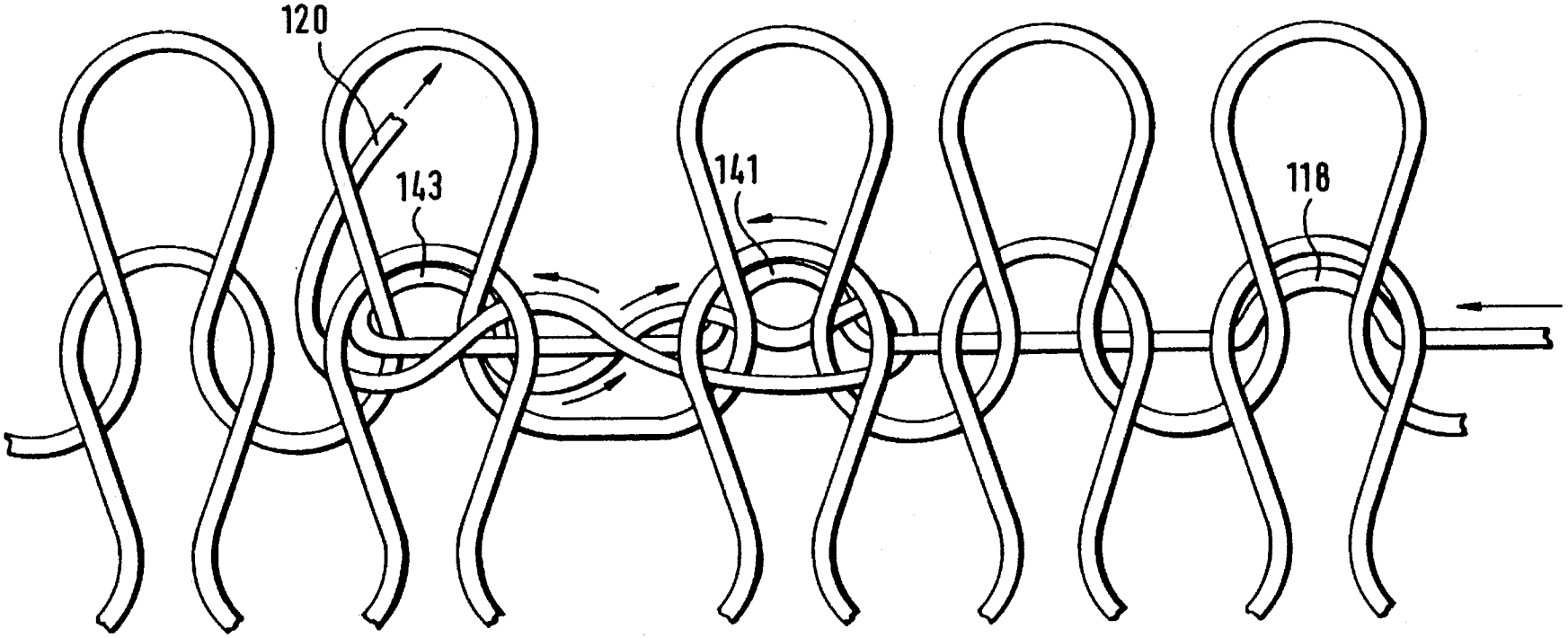
FIG. 37 is a plan view of knit goods provided with a yarn securing knot according to the second embodiment of the invention.

FIG. 37 shows a plan view of the knot made by the process step of FIG. 29 to 36. Arrows mark the yarn strand course in the knot, by which the individual loops and yarn bridges are indicated, particularly both loops 141 and 143 placed beside each other. FIG. 37 shows the knots extending over the width of two wales.

Figure 38:
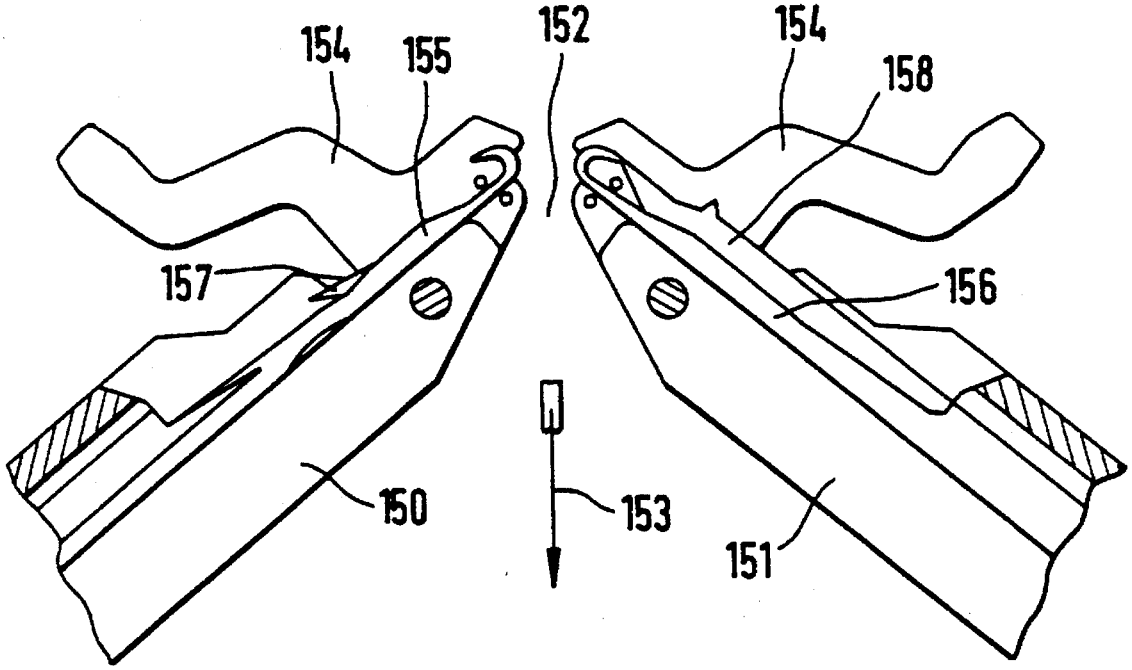
FIG. 38 is a schematic cross-sectional view through the end portion of both needle beds of a flat knitting machine.

FIG. 38 shows a cross-section through the upper ends of both needle beds, of the front needle bed 150 and of a rear needle bed 151, of a flat knitting machine, with which the above-described process for knot formation can be performed. Both needle beds 150,151 form a throughgoing slot 152 above which the knit goods formation and the knot formation occurs and through which a knit produce is drawn in the direction of the arrow 153. Both needle beds are equipped with equally formed down-holding plates 154, which are located between the needles of the needle beds and by which the gap 152 is closable by pivoting of the plates 154 periodically. The needle beds 150,151 can have either latch needles or slider needles. A latch needle 155 is shown in the needle bed 150 and a slider needle 156 is shown in the needle bed 151. In a known way the needle head is periodically closed by a pivotable latch 157 with the latch needles 154, while with the slider needles a closing of the needle head occurs by a slider 158.

The cam system carrier movable back and forth over the needle beds, on which the cam systems S1 to S3 are built, is not shown in FIG. 38. The knitting machine itself is a known flat knitting machine, with which the describe process of knot formation can be performed.

While the invention has been illustrated and described as embodied in a process for forming a yarn securing knot with a flat knitting machine, it is not intended to be limited to the details shown, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Process for forming a yarn securing knot with a flat knitting machine comprising a first and second needle bed, each of said needle beds being provided with a plurality of needles movable toward each other, and a carriage with cam parts for knitting, tucking and transferring devices, said process comprising the steps of:

a) looping one end portion of a new yarn strand (13,120) to be secured in a knit good at a knit good region edge of a knit good region with said needles of said first and second needle bed to form at least one loop (19,131) or stitch having legs in said first needle bed;

b) during successive carriage displacements, crossing over both of said legs of said at least one loop (19,131) or stitch formed in said first needle bed to form a crossed-over yarn portion associated with said at least one loop (19,131) or stitch; and c) transferring said at least one loop or stitch (19,131) having said legs crossed over by said crossed-over yarn portion (18,135) to one of said needles of said second needle bed.

2. Process as defined in claim 1, further comprising transferring another loop (21) or another stitch associated with another crossed-over yarn portion (20) to said needle of said second needle bed having said at least one loop or stitch (19,131) thereon.

3. Process as defined in claim 2, further comprising, after said transferring of said at least one loop (131) or stitch having said legs crossed over by said crossed-over yarn portion to said second needle bed, placing an additional loop (139) or an additional stitch on a further loop (133) or further stitch formed on another needle in said first needle bed to form a double loop structure, said other needle in said first needle bed accommodating said at least one loop (131) or stitch before said transferring, and subsequently transferring said double loop structure via a crossed-over portion of said double loop structure to another needle (115) of said second needle bed, said other needle being adjacent said needle of said second needle bed to which said at least one loop (131) or stitch has been transferred.

4. Process for forming a yarn securing knot with a flat knitting machine having at least two needle beds provided with needles movable toward each other and a carriage with cam parts for knitting, tucking and transferring devices, said process comprising the steps of:

a) transferring a stitch of a plain stitch row of an old yarn strand (11), said stitch being adjacent to a new yarn region of a plain stitch row, from a needle (P) of a first needle bed to a needle (12) of a second needle bed and forming loops of a new yarn strand (13) on a plurality of needles spaced from each other in a second needle bed, wherein said loops of said new yarn strand include a loop (19) on another needle (14) in said second needle bed leading said old yarn strand (11) in a carriage displacement direction (10), and another loop on said needle (P) of said first needle bed freed of said stitch;

b) after a carriage motion direction reversal, forming an additional loop with said new yarn strand (13) on a free needle (15) in said second needle bed closest to said old yarn strand (13) crossing legs of said other loop formed on said needle (P) of the first needle bed and legs of said loop (19) formed on said other needle (14) in said second needle bed; and forming additional loops on at least one additional needle (16) in said second needle bed;

c) after a carriage motion direction reversal following said direction reversal of step b), transferring said loop (19) having legs (**19*a*,19*b*) from said other needle (14) located next to said needle (12**) found in the second needle bed to an additional needle (*) of the first needle bed, retaining said old yarn stitch on said needle (12) of the second needle bed, said additional needle (*) of the first needle bed determining a beginning of said new yarn region, and crossing said legs (**19*a*,19*b*) of said loop (19) over a yarn bridge portion (18) drawn from said needle (P) in said first needle bed to said needle (15**) of said second needle bed having said other loop;

d) after a carriage motion direction reversal following said direction reversal of step c), casting off said other loop formed on said needle (P) in said first needle bed in step a);

e) after another carriage motion direction reversal following said direction reversal of step d), forming a new yarn loop on said needle (P) in said first needle bed freed in step d) and thereby forming a new yarn bridge portion (20) crossing all other new yarn bridge portions previously formed between both needle beds;

f) after an additional carriage motion direction reversal following said direction reversal of step e), transferring another new yarn loop (21) having legs and formed in said second needle bed to said additional needle (*) in said first needle bed and retaining said loop (19), thereby crossing said new yarn bridge portion (20) running between both of said needle beds with said legs of said new yarn loop (21);

g) after two further carriage motion direction reversals following said direction reversal of step f) and after casting off of said stitch transferred in step a), forming said new yarn strand (13) on said other needle (14) located in the carriage displacement direction following the needle (12) freed from said stitch in said carriage displacement direction; and guiding said new yarn strand (13) until over a leg of a next following loop located on a needle (16) in said second needle bed; casting off of said new yarn loop located on said needle (P) of said first needle bed and subsequently retransferring said loop transferred from said first needle bed to said second needle bed in step a) to said needle (P) in said first needle bed freed in step a); and h) after a further carriage motion direction reversal following said direction reversals of step g), casting off of said loops on said other needle (14) and said additional needle (16) in said second needle bed and subsequently forming a plain stitch row beginning said new yarn region on said needles of said first needle bed with said new yarn strand (13).

5. Process for forming a yarn securing knot with a flat knitting machine having at least two needle beds provided with needles movable toward each other and a carriage with cam parts for knitting, tucking and transferring devices, said process comprising the steps of:

a) stitching a plain stitch row with a new yarn strand (13) to be subsequently tied off in a first needle bed until at a knit good region and forming a closing loop (27) on a needle (O) at a knit good region edge in a carriage displacement direction;

b) transferring a stitch formed in said knit good region in step a) to a needle (12) in a second needle bed and with a carriage motion direction opposite said displacement direction of step a) transferring another stitch to another needle (14) located in front of a loop already in said carriage motion direction in said second needle bed and then to a needle (P) freed in said first needle bed to form yarn bridge portions;

c) after another carriage motion direction reversal following the direction reversal of step b), stitching of said new yarn strand to be tied off on a freed needle (15) in said second needle bed above and closest to said loop conveyed in step b) and crossing (28) of said yarn bridge portions drawn between said needle beds in step b) and stitching of said new yarn portion on at least one additional needle (16) following in said yarn carriage direction (1) in said second needle bed;

d) after a further carriage motion direction reversal following the direction reversal of step c) conveying another loop (29) formed in step b) in said second needle bed to another needle (*) of said first needle bed determining said knit good region edge and crossing of a yarn bridge portion (28) drawn from said second needle bed in step b) to said first needle bed by both legs of said other loop (29);

e) after a fresh carriage motion direction reversal following said direction reversal of step d), casting off said loop formed on said needle (P) in said first needle bed in step b);

f) after a new carriage motion direction reversal following the direction reversal of step e), forming a new loop on said needle (P) freed in said step e) and crossing of all of said yarn bridge portions formed between said needle beds with another yarn bridge portion (30) drawn from said new loop formed on said needle (P);

g) after an additional carriage motion direction reversal following the direction reversal of step f), transferring a further loop (31) having legs from said second needle bed to said other needle (*) of the first needle bed already accommodating said new loop (29) and crossing of said yarn bridge portion (30) drawn between said needle beds by said legs of said further loop (31);

h) after a fresh carriage motion direction reversal following the direction reversal of step g), casting off said loop formed on said needle (P) freed in said first needle bed in step b);

i) after a new carriage motion direction reversal following the direction reversal of step h), forming of an additional loop on a free needle (14) in said second needle bed located in said knit good region and subsequently guiding said new yarn strand (13) over legs of a next following loop in said carriage motion direction on a further needle (16) of said second needle bed and forming a further loop on at least one following needle of said second needle bed; and j) retransferring said loop shifted from said first needle bed to said second needle bed back to said needle (P) freed in said step b) of said first needle bed and casting off said loops located on said other needle (14) and said freed needle (15) freed in step c) in said second needle bed.

6. Process for forming a yarn securing knot with a flat knitting machine having at least two needle beds provided with needles movable toward each other and a carriage with cam parts for knitting, tucking and transferring devices, said process comprising the steps of:

a) transferring stitches located in a second needle bed in front of an edge (*) of a new knit good region to the stitches of a plain stitch row of an old knit good region in a first needle bed and transferring of a stitch (140) located next to said edge (*) of the new knit good region to a needle (123) in said second needle bed; with a leading cam system tying of a new yarn strand (120) by forming a loop (141) on another needle (125) in said second needle bed, said at least one other needle being located two needle spaces in front of an old yarn stitch (140) in a carriage displacement direction (10) and at least at a needle (113) released by said transferring in said first needle bed;

b) after a carriage motion direction reversal, forming additional loops (143,144) on respective additional needles (124,126) of said second needle bed, said additional needles (124,126) being positioned on respective sides of said other needle (125) and crossing legs of an old yarn stitch (140) already formed in step a) on said other needle (125) with a yarn bridge portion (145) with said leading cam system and transferring said loop (141) formed in step a) in said second needle bed to a further needle (115) in said second needle bed and crossing said yarn bridge portion (145) extending between said additional loops (143,144) formed previously;

c) after another carriage motion direction reversal following said direction reversal of step b), casting off another loop (142) formed on the needle (113) of said first needle bed with said leading cam system and with a trailing cam system forming another loop (146) on the other needle (125) in the second needle bed released by the looping in step b) and forming of a further loop (147) on said other needle (113) released by the previous casting off in the first needle bed and providing another yarn bridge portion (148) crossing legs of said other loop (146) formed previously in said second needle bed with said trailing cam system;

d) after a further carriage motion direction reversal following said direction reversal of step c), moving said additional loop (143) located in front of the loop (146) in the carriage displacement direction and newly formed in step c) in the second needle bed to a needle (114) located after the needle (113) in the carriage displacement direction and carrying the further loop (147) and crossing said other yarn bridge portion (148) between said loops (146,147)formed in step c) with the leading cam system (S1) and further drawing said further loop (147) formed in step c) in said first needle bed with said trailing cam system;

e) after a fresh carriage motion direction reversal following said direction reversal of step d), casting off said additional loop (144) formed in step b) first in a carriage displacement direction (10) in said second needle bed and of said further loop (147) drawn in step d) in said first needle bed;

f) after a new carriage motion direction reversal following said direction reversal of step e), swinging out of said yarn guide (111) guiding said new yarn strand (120);

g) after another carriage motion direction reversal following said direction reversal of step f), retransferring said old yarn stitch (140) transferred in step a) into said first needle bed with said leading cam system and further drawing said loop (141) looped in step b) in said first needle bed with said trailing cam system (S2); and h) after a further carriage motion direction reversal following said direction reversal of step f), casting off of said additional loop (144) formed in step c) in said second needle bed and further drawing of said additional loop (143) and said loop (141) located in said first needle bed.

7. Process for forming a yarn securing knot with a flat knitting machine having at least two needle beds provided with needles movable toward each other and a carriage with cam parts for knitting, tucking and transferring devices, said process comprising the steps of:

a) stitching a plain stitch row with a new yarn strand to be tied off in a first needle bed at least until at a knit good region edge (*);

b) in a carriage motion direction opposite to that of step a), transferring stitches located in front of the knit good region edge (*) from a second needle bed into said first needle bed and transferring a stitch (130) formed in step a) within a knit good region before said knit good region edge to a needle (123) of said second needle bed and forming loops (131,132) on another needle (125) of said second needle bed located at said knit good region edge (*) and subsequently on a needle (113) freed by transfer of said stitch (130) in said first needle bed with the new yarn strand (120) to be tied off with said trailing cam system (S2);

c) in a new carriage motion direction reversal following that of step b) and with a displacement of said second needle bed one needle space, stitching of said yarn strand (120) to be tied off in said second needle bed to forming loops (133,134) with the leading cam system (S1) on respective adjacent needles (124,126) of said second needle bed, said adjacent needles (124,126) being located beside said loop (131) on said other needle (125) formed in said second needle bed in step b), and crossing of both legs of said loop (131) by a yarn bridge portion (135) with said following cam system (S2);

d) after a fresh carriage motion direction reversal after that of step c) and after return of said second needle bed in a new carriage displacement direction (10) after said direction reversal, casting off said loop (132) located beside said loop (131) in said first needle bed by said leading cam system (S1), and with said trailing cam system (S2) forming another loop (136) and another stitch (139) over one of said loops (133,134) formed in step c) in said second needle bed and subsequently forming an additional loop (137) on said needle (113) released after said casting off and adjacent to said loop (131) in said first needle bed;

e) in an additional carriage motion direction reversal after that of step d), casting off said loop (134) formed in said second needle bed in step c) by said leading cam system (S1) and displacing said needle beds in a carriage displacement direction (10) after said carriage motion direction reversal following that of said step d) and with said following cam system (S2) transferring said other stitch (139) and said other loop (133) formed in step d) in said second needle bed to said first needle bed over said legs of said loop (131);

f) in a carriage motion direction reversal after that of step e) and after return of said second needle bed, further drawing said additional loop (137) formed in step d) in said first needle bed with said leading cam system (S1) and subsequently casting off said additional loop (137) by said following cam system (S2);

g) in a carriage motion direction reversal after that of step f) forming a further loop (138) on an additional needle (118) located outside said knit good region in said first needle bed with said leading cam system (S1) and retransferring back said stitch (130) formed in step b) by said following cam system (S2); and h) in a carriage motion direction reversal after that of step g) displacing said second needle bed into a transfer position, casting off said other loop (136) remaining in said second needle bed and further drawing of said loop (131) in said first needle bed by a leading cam system (S1) and drawing said loop (133) and said additional stitch (139) located in said first needle bed.

8. Knit goods having a rear side and comprising a knit good region having loop rows and whales and an Intarsia knit region adjacent said knit good region having loop rows, whales and corners and a yarn securing knot made by the process according to claim 1, located at a knot position close to said rear side of said knit good region at one of said corners of said Intarsia knit region and coincident with a knit loop so that a deformation in a knit structure in the vicinity of said knot position does not occur.

9. Knit goods having a rear side and comprising a knit good region having loop rows and whales and an Intarsia knit region adjacent said knit good region having loop rows, whales and corners and a yarn securing knot made by the process according to claim 2 located at a knot position close to said rear side of said knit good region at one of said corners of said Intarsia knit region and coincident with a knit loop so that a knit structure deformation in the vicinity of said knot position is not present.

10. Knit goods having a rear side and comprising a knit good region having loop rows and whales and an Intarsia knit region adjacent said knit good region having loop rows, whales and corners and a yarn securing knot made by the process according to claim 4 located at a knot position close to said rear side of said knit good region at one of said corners of said Intarsia knit region and coincident with a knit loop so that a deformation in knit structure is absent in the vicinity of said knot position.

11. Knit goods having a rear side and comprising a knit good region having loop rows and whales and an Intarsia knit region adjacent said knit good region having loop rows, whales and corners and a yarn securing knot made by the process according to claim 5 located at a knot position close to said rear side of said knit good region at one of said corners of said Intarsia knit region and coincident with a knit loop so that a deformation in a knit structure in the vicinity of said knot position does not occur.

12. Yarn securing knot made by the process as defined in claim 1.

13. Yarn securing knot made by the process as defined in claim 4.

14. Yarn securing knot made by the process as defined in claim 5.

15. Yarn securing knot made by the process as defined in claim 6.

16. Yarn securing knot made by the process as defined in claim 7.

17. Process as defined in claim 1, wherein said knit good region is an Intarsia good region.

* * * * *

UNITED STATES PATENT AND TRADEMARK OFFICE

CERTIFICATE OF CORRECTION

PATENT NO. : 5 467 616

DATED : November 21, 1995

INVENTOR(S) : Ruediger LOQUET, et al

It is certified that error appears in the above-identified patent and that said Letters Patent is hereby corrected as shown below:

On Cover Page:, item

[73] Change "H. Stroll GmbH & Co." to --H. Stoll GmbH & Co."

Signed and Sealed this

Sixteenth Day of April, 1996

Bruce Lehman

*Attest:*

BRUCE LEHMAN

*Attesting Officer*

*Commissioner of Patents and Trademarks*